US007200870B1

(12) United States Patent
Kolk

(10) Patent No.: US 7,200,870 B1
(45) Date of Patent: Apr. 10, 2007

(54) PROTECTIVE SLEEVE FOR THE FOREARM OF A WEARER

(76) Inventor: Patricia K. Kolk, 343 N. Tiago Dr., Gilbert, AZ (US) 85233

( * ) Notice: Subject to any disclaimer, the term of this patent is extended or adjusted under 35 U.S.C. 154(b) by 421 days.

(21) Appl. No.: 10/251,543

(22) Filed: Sep. 19, 2002

Related U.S. Application Data

(60) Provisional application No. 60/324,738, filed on Sep. 24, 2001.

(51) Int. Cl.
*A41D 13/08* (2006.01)

(52) U.S. Cl. ..... 2/16; 2/161.6; 2/167

(58) Field of Classification Search ..... 2/16, 2/159, 161.6, 161.7, 161.8, 162, 168, 167, 2/169, 59, 125, 268, 269
See application file for complete search history.

(56) References Cited

U.S. PATENT DOCUMENTS 3,922,740 A * 12/1975 Potter ..... 441/58
4,864,655 A * 9/1989 McKenney et al. ..... 2/93
5,014,689 A * 5/1991 Meunchen et al. ..... 602/21
5,105,478 A * 4/1992 Pyc ..... 2/115
5,402,536 A * 4/1995 Matthews ..... 2/16
5,581,812 A * 12/1996 Krocheski ..... 2/167
5,737,771 A * 4/1998 Aanonsen ..... 2/16
5,749,098 A * 5/1998 Evans ..... 2/123
5,815,837 A * 10/1998 Christman et al. ..... 2/158
5,924,130 A * 7/1999 Fragomeli ..... 2/16
6,021,524 A * 2/2000 Wu et al. ..... 2/167
6,449,772 B1 * 9/2002 Donner ..... 2/170

* cited by examiner

*Primary Examiner*—Gary Welch
*Assistant Examiner*—Andrew Sutton
(74) *Attorney, Agent, or Firm*—Gregory J. Nelson

(57) ABSTRACT

A protective sleeve for use when handling animals to protect against cuts and scratches. The sleeve has an outer puncture-resistant surface and a scratch-resistant layer. The sleeve tapers from the elbow toward the hand of the user. A thumb receiving aperture is provided near the lower end of the sleeve to provide stability and to permit free use of the hand. A glove may be attached or integral with the sleeve which is also made of a laminate puncture- and scratch-resistant material.

4 Claims, 4 Drawing Sheets

PROTECTIVE SLEEVE FOR THE FOREARM OF A WEARER

REFERENCE TO RELATED APPLICATION

This application is based on provisional application Ser. No. 60/324,738 filed Sep. 24, 2001, of the same title.

FIELD OF THE INVENTION

The present invention relates to a protective member and, more particularly to, a protective sleeve worn about the lower arm of the user intended for use when engaged in activities such as handling animals, particularly sharp toothed or clawed animals. A glove may also be attached to the sleeve to protect the hand of the user.

BACKGROUND OF THE INVENTION

Many individuals have pets which have either sharp claws or sharp teeth which can bite or scratch the individual. These cuts and scratches can occur when handling and fondling pets such as dogs, cats, ferrets and even birds. Similarly, injuries such as scratches and cuts can occur when bathing a pet, administering medication or when removing a pet from a situation which the pet or animal is frightened as when removing a kitten from a tree. Cuts and scratches which occur in these situations are generally minor, superficial injuries and heal in time. However, in some instances, these cuts or scratches can become infected and can transmit diseases to human which require medical attention.

The problem of cuts and scratches inflicted from handling animals is even more pronounced in the case of those engaged regularly in animal-related activities as a profession. Animal groomers, veterinarians, veterinarian assistants, zoo keepers, pet shops employees and similar personnel all encounter situations in which they may be either scratched, bitten or clawed by an animal.

As a result, there are various types of protective devices that can be found in prior art that are intended for use of handling animals. Most common of these are protective devices for use by a trainer training attack dogs. Reference is made in U.S. Pat. No. 3,902,196 which shows a device which has layers of nylon and nylon mesh and adjustment means which can be operated by one hand to facilitate attachment.

U.S. Pat. No. 4,382,301 discloses an interesting device which is a legging adapted to extend around the legs of the wearer to protect the wearer from snake bites. Protective devices of these types are intended for specific applications and would not be applicable to use by individuals or those involved in handling animals such as groomers and those who work in veterinarian offices.

Other types of protective garments or devices can be found in prior art not especially intended for use in handling animals. For example, U.S. Pat. No. 5,357,633 shows an arm protective garment which is an elongated tubular sleeve made of a flexible material which is open at one end and may be slipped over a driver's hand and arm. The garment includes a mitten for the end of the sleeve that receives the driver's hand. The mitten has a thumb opening. The garment also includes a flexible strap at the open end of the sleeve that will extend around the chest or neck of the driver to releasably retain the sleeve on the driver's arm.

The prior art most pertinent to the present invention appears to be U.S. Pat. No. 5,022,093. This patent discloses a protective type mitten or glove for use as a toy with which an individual may play with a kitten, cat or similar animal. The glove extends well up the forearm past the wrist, nearly to the elbow. The mitten is provided with features such as eyes and/or a nose that rattles. In addition, the glove incorporates a protective material such as heavy denim, leather or vinyl or the like, between the outer covering and the inner lining.

Notwithstanding the foregoing, there nevertheless exists a need for an effective protective device for preventing bites and scratches when handling animals.

BRIEF SUMMARY OF THE INVENTION

Briefly, the present invention provides a protective sleeve which is worn about the forearm of an individual to protect the forearm from bites and scratches when handling an animal. The sleeve tapers slightly from the upper end to the lower end so as to snugly fit about the forearm of the individual. An opening or aperture adjacent the lower end receives the thumb of the user to maintain the sleeve in a position when in the use and further allows the user unimpeded use of the fingers. The sleeve is made from a scratch-, cut-, bite- and puncture-resistant material.

In a preferred environment, the sleeve is a multi-ply or laminate assembly having a layer of rubber material such as neoprene or aramid fiber such as that sold under the trademark Kevlar® and which is coated with a puncture-resistant material such as nitrile rubber. A lining of material such as a cotton or nylon fabric or neoprene is laminated or applied to the inner surface of the sleeve for comfort and moisture absorption.

In an alternate embodiment, an intermediate reinforcing layer of cloth inserted rubber may be included at least in areas of the sleeve most likely to be subject to bites and scratches.

In yet another embodiment, the sleeve may include a glove which is either attached to the sleeve or which may be extended over the sleeve and may be removably attached to the sleeve with fasteners such as fabric loop-and-hook fabric fasteners. The glove is fabricated from a scratch resistant material such as an aramid fiber with an outer coating of a puncture resistant material such as nitrile rubber.

BRIEF DESCRIPTION OF THE DRAWING

The above are objects and advantages of the present invention will be more fully appreciated and understood from the following description, claims and drawings in which:

DETAILED DESCRIPTION OF THE DRAWING

Figure 2:
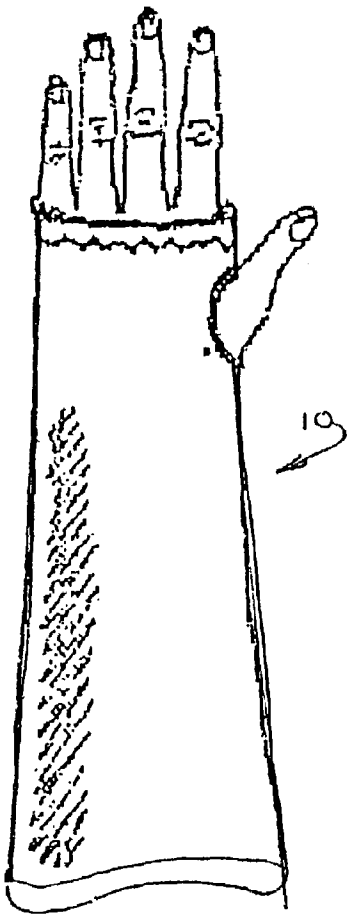
FIG. 2 is a view of the sleeve of the present invention worn on the left arm of a user with the user's palm facing downwardly.

Referring to the drawings, particularly FIGS. 1 to 5, the protective sleeve is a present invention is generally designated by the numeral 10. The sleeve 10 is utilized for protecting an arm "A" of the user against animal inflicted injury such as scratches, cuts and bites. The sleeve has a generally tubular body 12 which tapers slightly from the open upper end 14 to the open lower end 16. The protective sleeve may be provided in various sizes but it has been found that one or several sizes are suitable for use by most individuals and the tapered configuration allows it to be easily slipped on and off.

Typically, the sleeve is approximately 8" to 12" long and the larger, upper end 14 has a diameter of approximately 4" to 5" and the opening at the lower end 16 has a diameter of approximately 3" to 3½". The sleeve may be provided in several sizes to accommodate wearers of different physical size.

Figure 5:
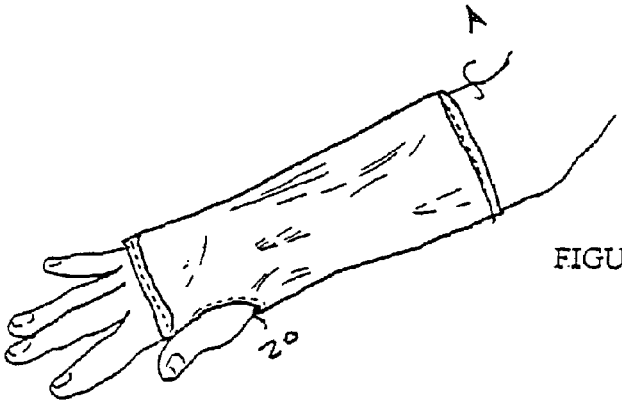
FIG. 5 is a perspective view showing the sleeve on the arm of a user.
Figure 3:
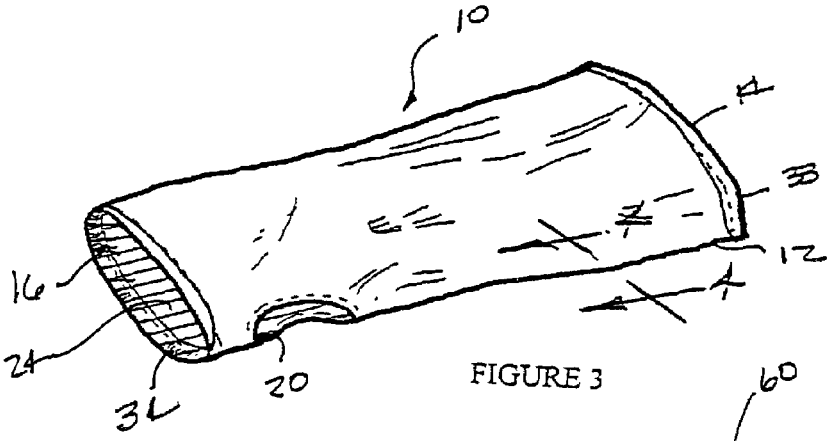
FIG. 3 is a perspective view of the protective sleeve.

Positioned adjacent the lower end of the sleeve is an aperture 20 is positioned to receive the thumb of the user. The aperture 20 has a diameter of approximately 1" to 2". As seen in FIG. 5, when the protective sleeve is worn about the forearm, the upper end 14 is positioned just below the elbow of the user and the lower end extends across the knuckles and intermediate palm area of the hand of the wearer. Thus, the user's thumb will extend through the aperture 20. The extension of the thumb through the aperture will serve to maintain the sleeve in position on the arm as the sleeve will be anchored against movement by the thumb. The thumb and the fingers are permitted to extend from the sleeve giving the user free, unimpeded use of the fingers and hand. Generally, when an animal is held or grasped, the animal will bite or scratch at the arm area rather than at the hands as the hand will be about the body of the animal.

Figure 4:
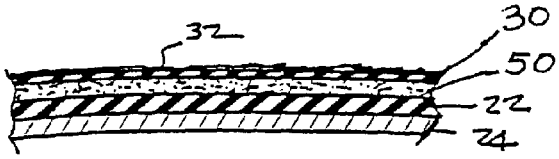
FIG. 4 is a cross sectional view along line 4—4 of FIG. 3 showing the various material layers of the sleeve.

The sleeve 10 of the present invention is fabricated from suitable cut-, bite-, scratch- and puncture-resistant materials which are strong and flexible. As shown in FIG. 4, the protective sleeve is fabricated from an inner layer or ply 22 of rubber such as a neoprene, 1 to 2 mm thick, laminated with a covering 24 of nylon on cotton on the inner surface. The inner layer 24 or lining of nylon or cotton is disposed against the arm of the user and is provided for comfort and moisture absorption.

Outer layer 30 is a flexible cut- and scratch-resistant material such as an aramid fiber fabric coated with an outer layer 32 nitrile rubber. The use of synthetic aramid fiber material as sold under the trademark Kevlar®, has been found to work well. The layer 30 provides scratch and cut resistance and the rubber coating 32 provides resistance to punctures.

Both the upper end 14 and lower end 16 of the sleeve are finished for comfort. A cuff 33 extends around at the upper end and cuff 34 extends around the lower end. The cuffs 33, 34 are formed by turning the interior layer 22 and extending it over the outer layer 30 and adhesively securing the turned edge in place or securing the edge by other techniques either by stitching or a heat binding technique.

Figure 1:
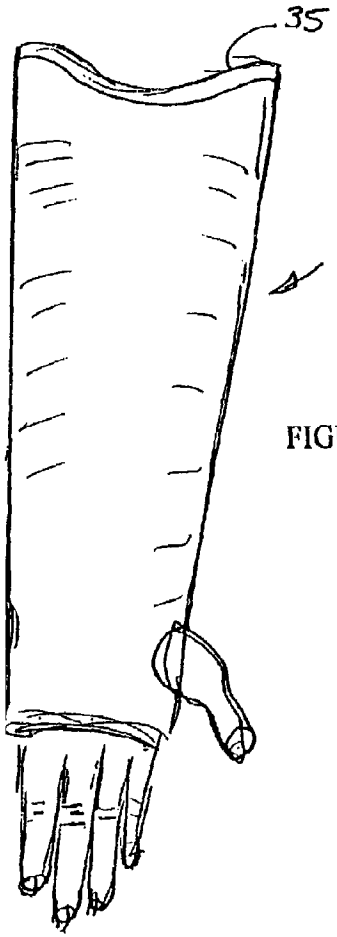
FIG. 1 is a view of the sleeve of the present invention shown worn on the arm of a user with the user's palm facing upwardly.

The cuff 33 is preferably formed having a contoured or relieved area 35 in an area corresponding to the inner forearm area of the user as best seen in FIG. 1. This contour 35 will assist in preventing the sleeve from being pushed forwardly toward the user's hand when the forearm is flexed or bent.

For some applications, such as use in veterinarian offices where animals are continually handled, a reinforced sleeve may be desired. In this instance, a middle or intermediate layer 50 is interposed between the inner and outer layers. Layer 50 is a flexible material such as cloth inserted neoprene placed between layers 22 and 30. For more rugged use, the intermediate layer 50 may be thicker, as for example 3 mm, in the area of the forearm.

Figure 7C:
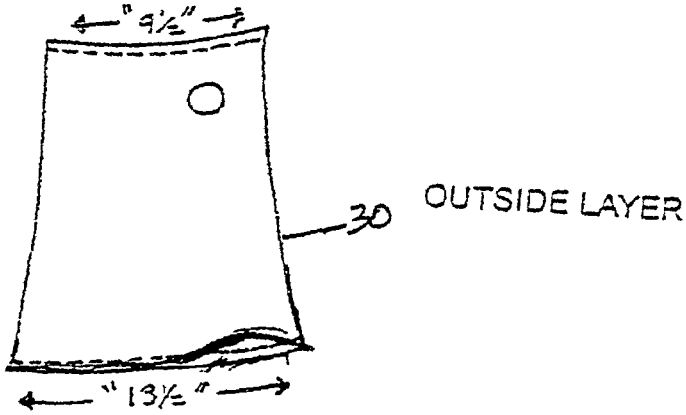
FIGS. 7A, 7B and 7C show the patterns for construction of various components with FIG. 7A showing the inner layer, FIG. 7B showing the middle layer and FIG. 7C showing the outer layer.
Figure 7B:
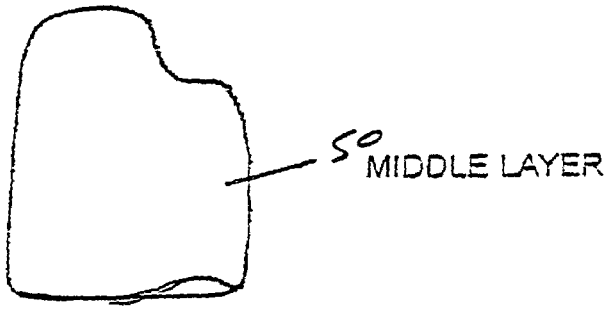
Figure 7A:
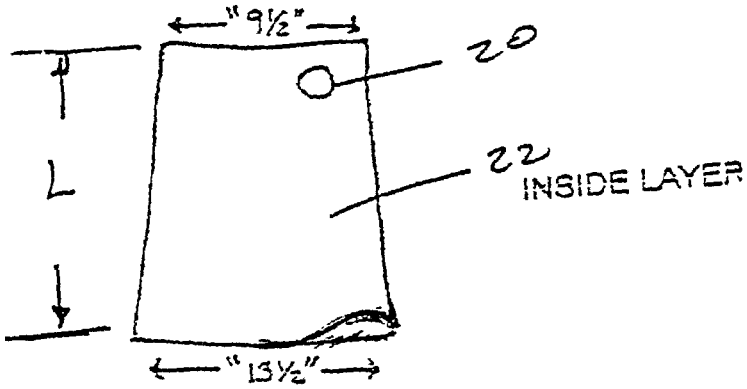

FIGS. 7A to 7C show the shapes of the representative patterns for the inner layer 22, outer layer 30 and optional intermediate layer 50 prior to assembly. Note inner 22 and outer layers 30 are generally trapezoidal in shape and the inner layer is slightly less in length "L" than the outer layer 30.

Figure 9:
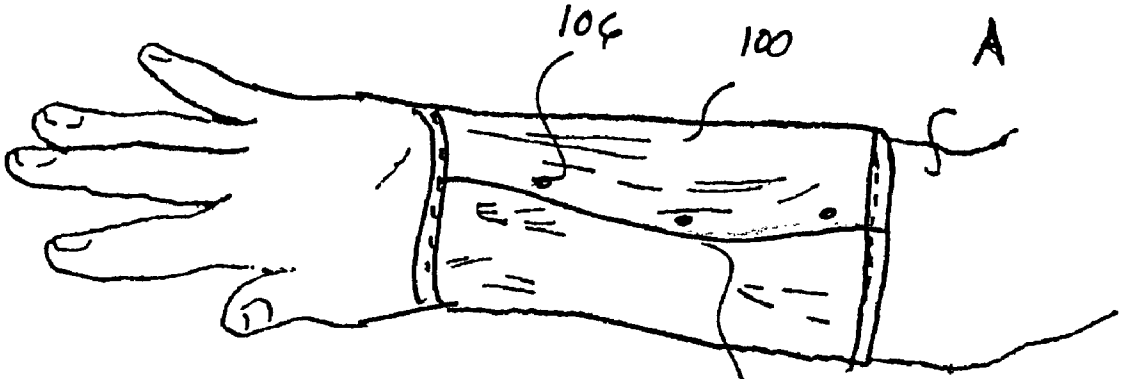
FIG. 9 shows an arm wrap that may be separately worn in lieu of a sleeve having an inner layer.

In some instances, the user may prefer an arm wrap 100 as seen in FIG. 9. The arm wrap is a tubular structure of lined rubber such as neoprene with a laminated lining of cotton or nylon. The wrap may also be leather or other protective material and may also be securable about the arm along edge 105 by snap fasteners 106 or by equivalent fasteners such as fabric loop and hook style fasteners. The wrap will be worn with a sleeve having only a single material layer of Kevlar® and may be slipped over the lower arm prior to donning the sleeve 10 for added protection.

EXAMPLE I

A protective sleeve 10 according to the invention was fabricated as follows:

(1) Outer Layer 30 was cut to the shape indicated in FIG. 7 from a piece of 3 mm neoprene. A one and one-half inch (1½") circle was cut out of the fabric to serve as the thumb hole 20 cut one and one-half inches from the top. The right edge of the circle was two and one quarter inches (2¼") from the right side of the material.

(2) Middle Layer 50: A section of cloth-inserted neoprene was cut to the shape indicated in FIG. 7. This piece is placed between the two neoprene layers and sewn together to provide increased protection in the forearm area.

(3) Inner Layer 22: A piece of 1.5 mm neoprene was cut out to the shape seen in FIG. 7. The inside layer was rubber having a covering of nylon which when worn is disposed against the arm of the user. The inner layer was approximately the same dimensions as the outer layer with the exception of being about one-half inch shorter in length on both ends to allow the cuffs to be formed by turning the edge and attaching a binding for a more finished appearance.

EXAMPLE II

A protective sleeve 10 according to the invention was fabricated as follows:

(1) An inner layer 22 was fabricated from neoprene as set forth above in Example I.

(2) An outer layer 30 was cut to the shape shown in FIG. 7 from a 5.5 OSY Kevlar® Swiss Pique laminated to an all cotton fabric made on a 27 gauge interlock. The cotton was 4.2 osy when coated with carboxylated nitrite rubber to provide the outer covering 32. The total weight was 15.7 osy.

The sleeves, as described in Examples I and II, were sewn with a nylon or polyester thread weighted at 69. The outside layer was folded down at each end one and one half inches and zig-zag stitched to create the finished edges. A cloth inserted neoprene layer, as seen in FIG. 7B, may be inserted between the inner and outer layers in the sleeve.

The thumb hole is straight-stitched then re-stitched with a zig-zag stitch for reinforcement. Once these two steps have been completed, the lateral edges are straight-stitched and then zig-zag stitched with the sleeve in an inside out position.

Finally, the glove was turned inside out to form the finished product. A logo may be applied by silk screening to the outer surface or to a tag or label sewn into or attached to the product.

Figure 6:
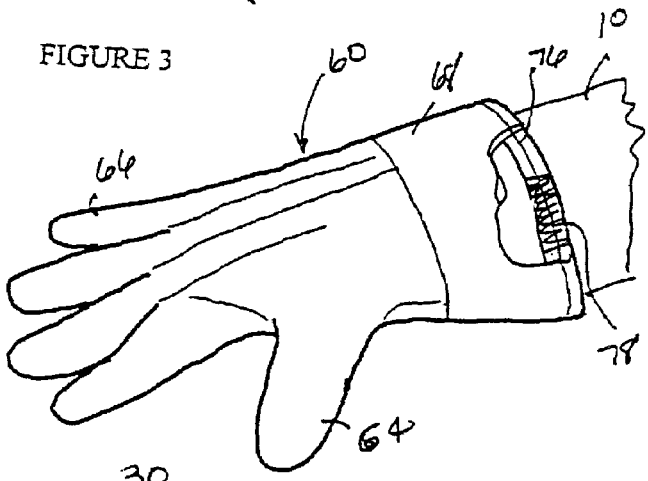
FIG. 6 is a perspective view of an optional glove component which may be secured to the sleeve.

Referring to FIG. 6, an alternate embodiment is shown in which the protective sleeve 10 is as has been described above. A glove 60 having a body 62 with an extending thumb pocket 64 and finger pockets 66 is a small multiple ply structure fabricated from puncture- and scratch-resistant materials such as aramid fiber having a rubber coating and having sufficient flexibility to enable free use of the hand and finger. The cuff 68 of the glove extends to a location overlapping the lower end of the sleeve and may be provided with fasteners members 76 which cooperate with mating fastener members 78 on the lower end of the sleeve so the glove may be easily attached or detached from the sleeve as required by the particular task. Preferably the fasteners 76 are on the inner surface of cuff 68 and the outer surface of the sleeve. The fasteners 76, 78 may be optional. The glove may also be integrally formed as part of the sleeve.

Figure 8:
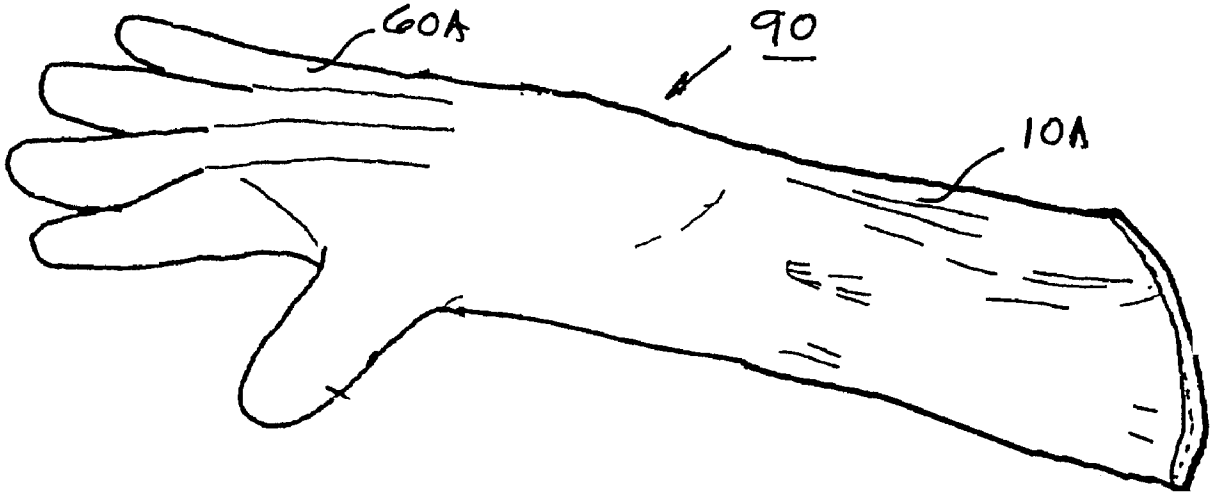
FIG. 8 illustrates an alternate embodiment in which a glove is integral with the sleeve.

In FIG. 8, yet another embodiment 90 is shown in which the glove portion 60A and the sleeve 10*a* are integrally formed in a gauntlet style. The glove and sleeve are fabricated from an outer aramid fiber material coated with nitrile rubber or a neoprene having an inner layer of neoprene laminated with cotton or nylon.

Since the hand of the user is less susceptible to cuts and scratches and, further, in order to provide the user freedom of movement, it is preferred the glove be only one or two layers such as an aramid fiber layer with an outer puncture-resistant coating of rubber, such as nitrile rubber.

From the foregoing, it will apparent that the present invention provides an effective device for protecting user against minor injuries resulting from handling or playing with an animal. The sleeve may be used by individual pet owners that will be particularly use in veterinary clinics and grooming salons where individuals required to handle pets when grooming pets, spraying, dipping or bathing animals or administering medication to an animal. In these situations, the animals are often frightened and is being handled by unfamiliar persons and will bite or scratch.

It will be obvious to those skilled in the art to make various changes, alterations and modifications to the invention described herein. To the extent these various changes, alterations and modifications do not depart from the spirit and scope of the appended claims, they are intended to be encompassed therein.

I claim:

1. A protective member for the forearm and hand of a wearer when handling animals comprising:

(a) a generally tubular sleeve having an upper and a lower end, said sleeve tapering from the upper to the lower end and adapted to fit over the forearm of the user extending to the palm area of a user's hand, said lower end defining a single opening allowing the wearer's fingers to fully protrude;

(b) said sleeve being a flexible laminate structure including a layer of rubber coated aramid fiber and a layer of neoprene lined with a moisture absorbing material; and (c) said sleeve defining a thumb receiving aperture adjacent to said lower end.

2. The protective member of claim 1 further including a glove of a scratch resistant material and having fastener means for detachably securing said glove to the lower end of said sleeve.

3. The protective member of claim 1 wherein the sleeve is dimensioned to extend from approximately the hand to the elbow of the elbow of the user and wherein said upper end is contoured to allow free bending of the elbow.

4. The protective member of claim 1 further including an arm wrap of scratch-resistant material worn beneath the sleeve.

* * * * *